US008561263B2

(12) United States Patent
Catanese

(10) Patent No.: US 8,561,263 B2
(45) Date of Patent: Oct. 22, 2013

(54) BRACELET CLASP

(75) Inventor: Rocco Catanese, Bienne (CH)

(73) Assignee: Omega SA, Bienne (CH)

( * ) Notice: Subject to any disclaimer, the term of this patent is extended or adjusted under 35 U.S.C. 154(b) by 16 days.

(21) Appl. No.: 13/415,045

(22) Filed: Mar. 8, 2012

(65) Prior Publication Data

US 2012/0240360 A1 Sep. 27, 2012

(30) Foreign Application Priority Data

Mar. 21, 2011 (EP) ..... 11159074

(51) Int. Cl.
*A44C 5/24* (2006.01)

(52) U.S. Cl.
USPC ..... 24/71 J; 24/265 WS

(58) Field of Classification Search
USPC ..... 24/68 J, 69 J, 70 J, 71 J, 71 R, 265 WS, 24/265 BC, 265 EC; 224/164, 176; 63/9
See application file for complete search history.

(56) References Cited

U.S. PATENT DOCUMENTS 4,424,611 A * 1/1984 Mori ..... 24/192
6,185,799 B1 * 2/2001 Gay ..... 24/715
7,124,478 B2 * 10/2006 Aquillon et al. ..... 24/265 WS

FOREIGN PATENT DOCUMENTS

EP 1 654 950 A1 5/2006

* cited by examiner

*Primary Examiner* — James Brittain
(74) *Attorney, Agent, or Firm* — Sughrue Mion, PLLC

(57) ABSTRACT

A bracelet clasp with an unfolding buckle includes a lever (2) pivotably mounted on a cap (1) by a first hinge (3*a*), the lever controlling a bolt (4) which is in turn mounted on the cap (1) by a second hinge (3*b*) distinct from the first. The bolt (4) is arranged to cooperate with a hook (22) fitted to the first arm (8) of the clasp. Elastic mechanism (5) is arranged for keeping the lever (2) in a non-raised position and the bolt (4) engaged with the hook (22) when the lever is not manually activated.

4 Claims, 2 Drawing Sheets

BRACELET CLASP

This application claims priority from European Patent Application No 11159074.1 filed Mar. 21, 2011, the entire disclosure of which is incorporated herein by reference.

FIELD OF THE INVENTION

The present invention relates to a bracelet clasp including at least two arms articulated to each other; a first arm, one end of which is attached to a bracelet strand, the other end being articulated on a first end of a second unfolding arm, the second end of which is traversed by an arbour about which there is articulated a cap, provided with first and second flaps and to which another bracelet strand is attached, and a lever fastening system for locking said first and second arms.

BACKGROUND OF THE INVENTION

This clasp, also called an unfolding buckle clasp, is well known in the state of the art and usually includes one or two push buttons as the fastening system. However, a lever has sometimes been proposed to replace the conventional push buttons and it is this that will be developed by the present invention.

A clasp implementing a control lever and broadly matching the brief description given hereinbefore is disclosed in EP Patent No. 1654950. This clasp includes at least two branches articulated to each other by one of the respective ends thereof. One of the free ends of these branches includes a lever articulated about an arbour parallel to the axis of articulation of the branches and integral with a hook, the other free end of these branches including a hooking element shaped to enable the hook to engage therewith to hold the branches in the folded position. The lever includes elastic means for exerting torque thereon and stop means for limiting the pivoting thereof, via the effect of the torque, about said arbour, in a position corresponding at least to the engagement of the locking hook with the hooking element, wherein the elastic means are biased, such that the lever has to pivot against the elastic means to engage and to release the locking hook from the hooking element.

In this prior art document, it is clear that the lever must be raised in order to open the clasp, which is quite natural and expected, but the lever also has to be raised in order to close and lock the clasp, which complicates the closing operation and makes it tedious. It is an object of the present invention to make it unnecessary to handle the control lever during the closing operation and to propose a design that achieves this object.

SUMMARY OF THE INVENTION

Thus, in addition to satisfying the generic definition set out in the first paragraph of this description, the present invention is characterized in that a lever is pivotably mounted on the cap by means of a first hinge, said lever controlling a bolt, which is in turn pivotably mounted on said cap by means of a second hinge, distinct from the first hinge, said bolt being arranged to cooperate with a hook fitted to the first arm and to lock the clasp when the latter is pushed into the fastening position, elastic means being arranged to keep the lever in a non-raised position and the bolt engaged with the hook when said lever is not manually activated.

BRIEF DESCRIPTION OF THE DRAWINGS

The features and advantages of the present invention will appear from the following description, given with reference to the annexed drawings, and providing, by way of explanatory, but non-limiting example, an advantageous embodiment of a clasp. In the drawings.

DETAILED DESCRIPTION OF THE PREFERRED EMBODIMENTS

Figure 1:
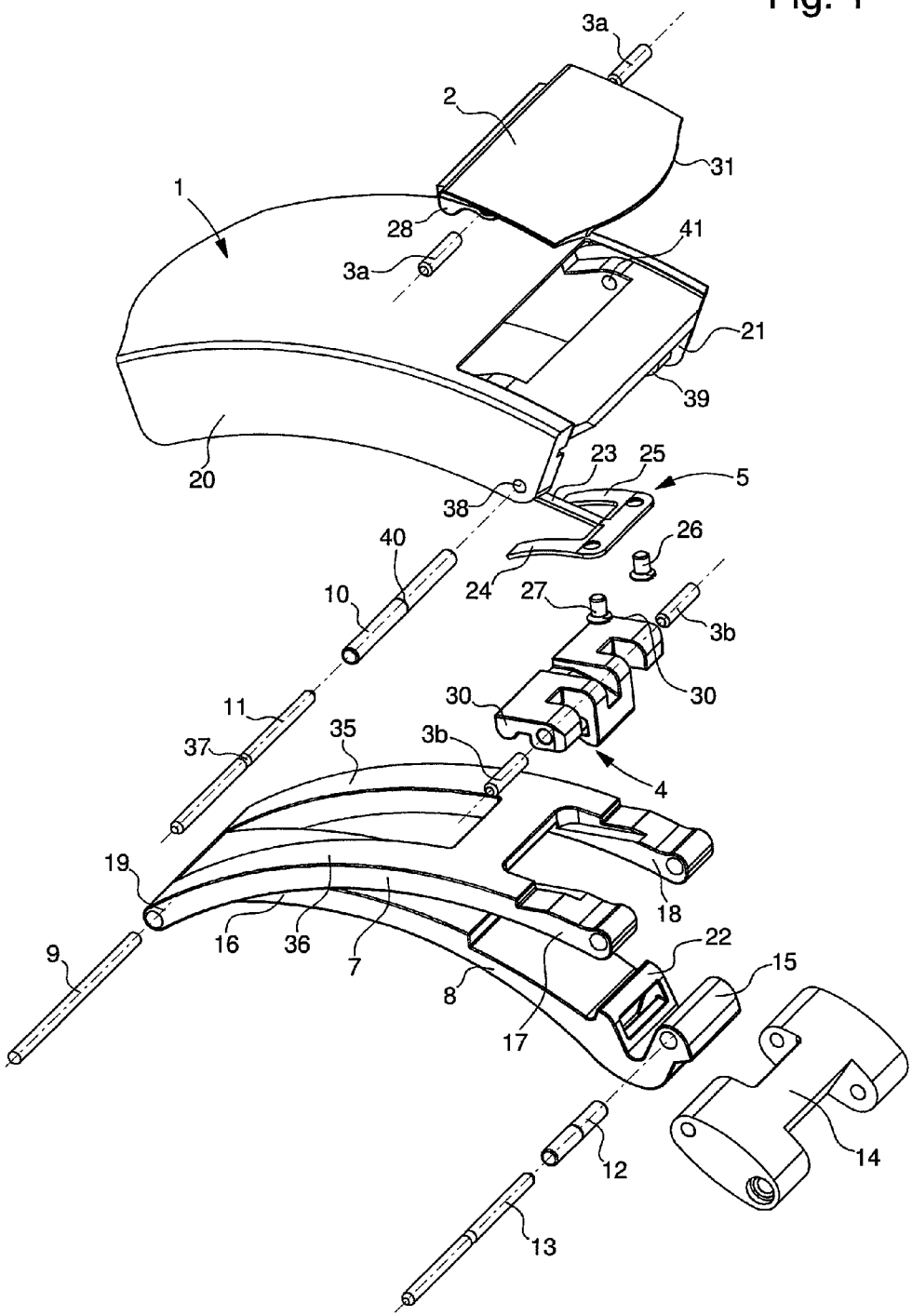
FIG. 1 is an exploded perspective view of the clasp according to the invention.

FIG. 1 is an exploded view of the clasp of the invention and the various parts of which it is composed. In a known manner, the clasp includes a first arm 8, one end 15 of which is attached to a bracelet strand 14, the bracelet being represented here by a first link. The other end 16 of first arm 8 is articulated by means of an arbour 9 on a first end 19 of a second unfolding arm 7. In this particular case, the second arm 7 is formed of two side members 35 and 36 between which the first arm 8 is inserted when the clasp is in the fastening position. This second arm 7 is traversed at the second end 17 and 18 by an arbour 11 about which there is articulated a cap or cover 1, provided with first and second flaps 20 and 21. Another bracelet strand (not shown in the Figure) and extending from said cap 1 to the left of the Figure is attached to said cap 1. In a conventional manner, arbour 11 is provided with a notch 37 and is held in place between the holes 38 and 39 respectively made in flaps 20 and 21 of cap 1, by a pipe 10 provided with a constricted portion 40. FIG. 1 also shows that the clasp of the invention includes a fastening system with a lever 2 for locking first and second arms 8 and 7.

This fastening system is novel and forms the essential element of the present invention which will now be described. FIG. 1 shows that a lever 2 is pivotably mounted on cap 1 by means of a first hinge formed of two small pins 3*a* penetrating holes 41 made in flaps 20 and 21 of cap 1. FIG. 1 and more particularly FIGS. 3 to 8 show that lever 2 controls a bolt 4 which is in turn pivotably mounted on cap 1 by means of a second hinge, distinct from the first and formed of two small pins 3*b*. These small pins 3*b* penetrate holes made in flaps 20 and 21 of cap 1. The holes are not visible in FIG. 1. Bolt 4 is controlled by lever 2 via a raised portion 28 made on the back of lever 2. Bolt 4 is arranged to cooperate with a hook 22 fitted to first arm 8 and to lock the clasp when the latter is pushed into the fastening position. Finally the Figures show that the clasp is fitted with elastic means 5 arranged to keep lever 2 in the non-raised position and bolt 4 engaged with hook 22 when the lever is not manually activated.

Figure 4:
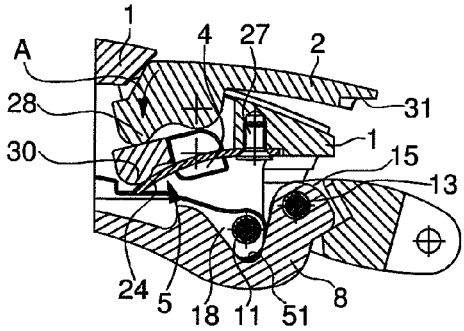
FIG. 4 is a vertical cross-section passing through an external strip of the elastic means and through a screw fixing said means to the cap, with the lever raised.

In particular, this elastic means 5 takes the form of a plate fixed to cap 1 by means of screws 26 and 27 as seen in FIG. 1. This plate 5 is cut into the shape of a rake and has a central strip 23 resting on a boss 50 formed on the back of lever 2, which is clearly shown in FIGS. 5, 6 and 7. Plate 5 also has two external strips 24 and 25 resting on raised portions 30 formed on the back of bolt 4, which is clearly shown in FIGS. 4 and 8. FIGS. 4 and 8 also show one of the screws 27 securing plate 5 to cap 1.

All of the Figures show that lever 2 is a plate provided with a grippable portion 31 which is used to lift the lever when the clasp has to be opened. When it is not activated, this plate merges with the top of cap 1.

Figure 2:
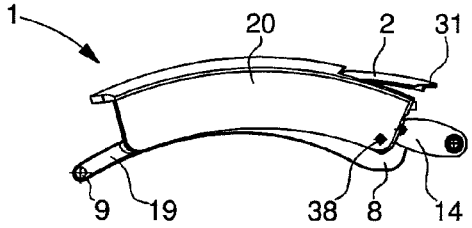
FIG. 2 is a side view of the clasp of the invention shown closed, with the opening lever raised.

It was indicated hereinbefore that the first and second hinges about which lever 2 and bolt 4 respectively pivot are mounted on cap 1. Thus, the first and second flaps 20 and 21 forming part of cap 1 will be used to run parallel to these hinges. The small pins 3*a* and 3*b* forming these hinges are mounted from the exterior of the flaps in holes formed for this purpose, then laser welded. In a preferred variant, the external parts of the holes are touched up to make the hinges invisible. Consequently, only orifice 38 shown in FIG. 2 will remain, owing to which arbour 11 can be removed and the clasp taken apart.

The operation of the clasp will now be explained with reference to FIGS. 3 to 8 which are vertical cross-sections taken in the perspective drawing of FIG. 1.

Figure 3:
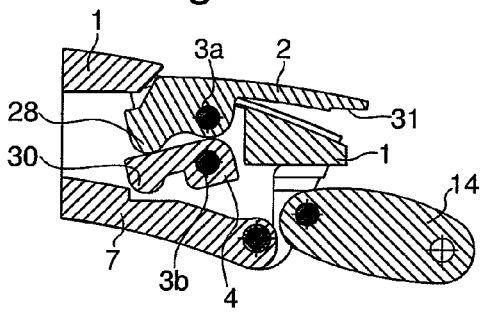
FIG. 3 is a vertical cross-section passing through the axes of rotation of the lever and the bolt shown in FIG. 1, with the lever raised.
Figure 5:
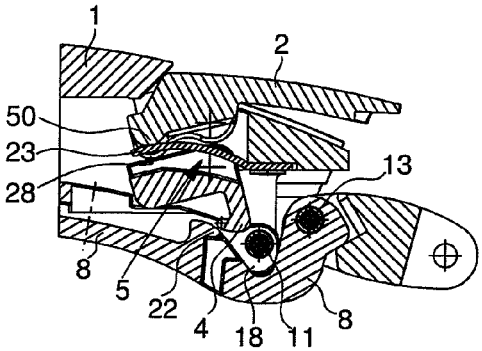
FIG. 5 is a vertical cross-section passing through the central strip of the elastic means, and through the bolt and the hook, which are detached, with the lever raised.

FIGS. 3 to 5 explain how the clasp is opened.

FIG. 3 is a vertical cross-section showing that the axis of rotation of lever 2 and the axis of rotation of bolt 4 are distinct from each other, said axes of rotation including respectively pins 3*a* and 3*b* mounted in flaps 20 and 21 of cap 1. As will be seen hereinafter, the implementation of these two axes, which do not exist in the aforecited EP 1 654 950 clasp, constitutes the main idea of the present invention, to avoid raising the lever when the clasp is closed.

FIG. 4 is a vertical cross-section passing through one of the external strips 24 and 25 forming elastic means 5, secured to cap 1 by two screws 27 and 26. This cross-section passes through strip 24 and screw 27. Using grippable portion 31, lever 2 is raised in the direction of arrow A. The raised portion 28 fitted to lever 2 rotates bolt 4, winding strip 24.

FIG. 5 is a vertical cross-section passing through the central strip 23 of elastic means 5. This cross-section shows that the central strip 23 is wound by a boss 50 of lever 2, with said lever remaining still raised. It is seen that bolt 4 has escaped from hook 22 carried by first arm 8. The second arm 7 of the clasp, the end 18 of which is visible here, is no longer held pressed against first arm 8 and the clasp can open.

Figure 6:
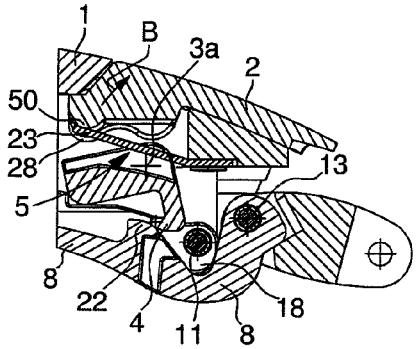
FIG. 6 is a vertical cross-section showing the position of the elements forming the clasp, with the bolt and hook detached, just prior to the clasp being locked, with the lever folded down.
Figure 7:
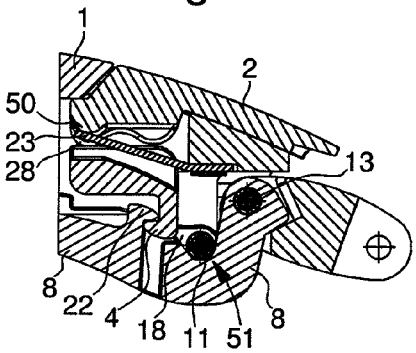
FIG. 7 is a vertical cross-section passing through the central strip of the elastic means, and through the bolt and the hook which are engaged, with the lever folded down.
Figure 8:
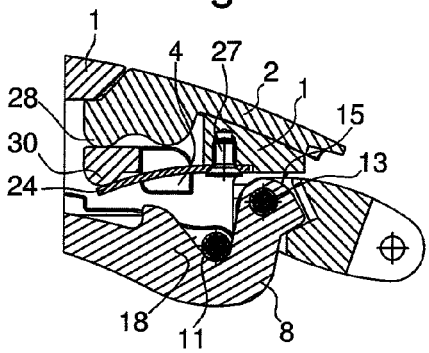
FIG. 8 is a vertical cross-section passing through an external strip of the elastic means and through a screw fixing said means to the cap, with the lever folded down.

FIGS. 6 to 8 explain how the clasp is closed.

FIG. 6 is a vertical cross-section showing the position of the elements forming the clasp just before the clasp is locked. The cross-section passes through the central strip 23 of elastic means 5. Lever 2 is no longer manually raised and has rotated about pin 3*a* in the direction of arrow B, returned by strip 23. FIG. 23 shows that the surface of lever 2 has a solution of continuity with the surface of cap 1 and that it is merged therewith. FIG. 6 also shows that just before the clasp is locked, the head of bolt 4 is in contact with the tip of hook 22 of first arm 8.

FIG. 7 is a vertical cross-section passing through the central strip 23 of elastic means 5. It shows the position of the elements forming the clasp in the locked position. A manual application of pressure on cap 1 has caused the head of bolt 4 to be placed underneath the hook 22 of first arm 8 which locks the clasp. In this situation, the first arm 8 rests between the side members 35 and 36 of the second arm 7 and arbour 11 passing through the second ends 17 and 18 of said second arm 7 is at the bottom of a groove 51 made towards the end of first arm 8.

Finally, FIG. 8 is a vertical cross-section passing through the external strip 24 of elastic means 5 and securing screw 27. The clasp is in the locked position and lever 2 is folded down onto cap 1. This Figure clearly shows the abutment of strip 24 against the raised portion 30 of bolt 4 which keeps the head of bolt 4 properly engaged with hook 22 of first arm 8.

With the explanations given hereinbefore, it is clear that the clasp is fastened without tipping lever 2 which has remained in place during the entire operation, said lever 2 being held pressed against cap 1. It will also be noted that the design that has just been described makes the force necessary to raise lever 2 independent of the force exerted on the bracelet strands, and said opening force can be adapted to various types of bracelets (for men, or ladies) simply by changing elastic means 5.

What is claimed is:

1. A bracelet clasp including at least two arms articulated to each other, a first arm, one end of which is attached to a strand of the bracelet, the other end being articulated on a first end of a second unfolding arm traversed at the second end thereof by an arbour about which there is articulated a cap provided with first and second flaps and to which another strand of the bracelet is attached, and a fastening system with a lever for locking said first and second arms, wherein a lever is pivotably mounted on the cap by means of a first hinge, said lever controlling a bolt which is in turn pivotably mounted on said cap by means of a second hinge, distinct from the first, said bolt being arranged to cooperate with a hook fitted to the first arm and to lock the clasp when the clasp is pushed into a fastening position, elastic means being arranged to hold the lever in a non-raised position and the bolt engaged with the hook when said lever is not manually activated.

2. The clasp according to claim 1, wherein the elastic means takes the form of a plate fixed to the cap by means of screws, said plate being cut in the form of a rake having a central strip abutting on a boss formed on the back of the lever, and two external strips abutting on raised portions formed on the back of the bolt.

3. The clasp according to claim 1, wherein the lever is a plate provided with a grippable portion, and wherein, when not activated, said plate merges with the top of the cap.

4. The clasp according to claim 1, wherein the first and second hinges about which the lever and the bolt respectively pivot, are mounted in the flaps of the cap.

* * * * *